US005322597A

United States Patent [19]

Childs et al.

[11] Patent Number: 5,322,597

[45] Date of Patent: Jun. 21, 1994

[54] BIPOLAR FLOW CELL AND PROCESS FOR ELECTROCHEMICAL FLUORINATION

[75] Inventors: William V. Childs, Stillwater; Frank W. Klink, Oak Park Heights; John C. Smeltzer, Woodbury; Jeffrey C. Spangler, Eagan, all of Minn.

[73] Assignee: Minnesota Mining and Manufacturing Company, St. Paul, Minn.

[21] Appl. No.: 923,100

[22] Filed: Jul. 30, 1992

[51] Int. Cl.[5] ..... C25B 3/08; C25B 9/00; C25B 11/02; C25B 15/08

[52] U.S. Cl. ..... 204/59 F; 204/228; 204/268; 204/269

[58] Field of Search ..... 204/59 F, 268–269, 204/228, 267

[56] References Cited

U.S. PATENT DOCUMENTS

| | | | |
|---|---|---|---|
| 2,519,983 | 8/1950 | Simons | 204/62 |
| 2,806,817 | 9/1957 | Wolfe | 204/59 F |
| 3,028,321 | 4/1962 | Danielson | 204/59 |
| 3,692,643 | 9/1972 | Holland | 204/59 |
| 3,753,876 | 8/1973 | Voss et al. | 204/59 |
| 3,853,737 | 10/1974 | Childs | 204/59 F X |
| 3,957,596 | 5/1976 | Seto | 204/59 |
| 4,139,447 | 2/1979 | Faron et al. | 204/268 X |
| 4,139,447 | 2/1979 | Faron et al. | 204/239 |
| 4,203,821 | 5/1980 | Cramer et al. | 204/268 |
| 4,406,768 | 9/1983 | King | 204/268 |
| 4,500,403 | 2/1985 | King | 204/255 |
| 4,568,440 | 2/1986 | Sutter et al. | 204/268 |
| 4,739,103 | 4/1988 | Hansen et al. | 560/125 |
| 4,938,849 | 7/1990 | Davies et al. | 204/59 F X |
| 4,950,370 | 8/1990 | Tarancon | 204/128 |

FOREIGN PATENT DOCUMENTS

| | | | |
|---|---|---|---|
| 2516355 | 10/1976 | Fed. Rep. of Germany | 204/59 F |
| 2-30785 | 2/1990 | Japan | C25B 3/08 |
| 1666581A1 | 7/1991 | U.S.S.R. | C25B 9/00 |

OTHER PUBLICATIONS

J. Burdon et al., *Advances in Fluorine Chemistry* (M. Stacey, J. C. Tatlow, & A. G. Sharpe, editors), vol. 1, pp. 129–137, Butterworths Scientific Publications, London (1960).

W. V. Childs et al., *Organic Electrochemistry* (H. Lund & M. M. Baizer, editors), 3rd Ed., pp. 1103–1112, Marcel Dekker, Inc., New York (1991).

A. J. Rudge, *Industrial Electrochemical Processes* (A. T. Kuhn, editor), pp. 71–75, Marcel Dekker, Inc., New York (1967).

D. E. Danly, *J. Electrochem. Soc.: REVIEWS AND NEWS* 131(10), 435C–42C (1984).

D. E. Danly, *Emerging Opportunities for Electroorganic Processes*, pp. 132–136 and 166–174, Marcel Dekker, Inc., New York (1984).

*Primary Examiner*—Donald R. Valentine

*Attorney, Agent, or Firm*—Gary L. Griswold; Walter N. Kirn; Lucy C. Weiss

[57] ABSTRACT

An electrochemical fluorination process comprises passing by forced convection a liquid mixture comprising anhydrous hydrogen fluoride and fluorinatable organic compound, e.g., tripropyl amine, at a temperature and pressure at which a substantially continuous liquid phase is maintained, between the electrodes of a bipolar electrode stack. The bipolar electrode stack comprises a plurality of substantially parallel, spaced-apart electrodes made of an electrically-conductive material, e.g., nickel, which is essentially inert to anhydrous hydrogen fluoride and which, when used as an anode, is active for electrochemical fluorination, and the electrodes of the stack are arranged in either a series or a series-parallel electrical configuration. The bipolar electrode stack has an applied voltage difference which produces a direct current which can cause the production of fluorinated organic compound, e.g., perfluoro(tripropyl amine). An electrochemical fluorination cell which can be used for carrying out the process is also described.

18 Claims, 5 Drawing Sheets

BIPOLAR FLOW CELL AND PROCESS FOR ELECTROCHEMICAL FLUORINATION

This invention relates to an electrolytic cell for electrochemical fluorination. In another aspect, this invention relates to an electrochemical fluorination process.

Fluorochemical compounds and their derivatives (sometimes called organofluorine compounds or fluorochemicals) are a class of substances which contain portions that are fluoroaliphatic or fluorocarbon in nature, e.g., nonpolar, hydrophobic, oleophobic, and chemically inert, and which may further contain portions which are functional in nature, e.g., polar and chemically reactive. The class includes some commercial substances which are familiar to the general public, such as those which give oil and water repellency and stain and soil resistance to textiles, e.g., Scotchgard TM carpet protector.

An industrial process for producing many fluorochemical compounds, such as perfluorinated and partially-fluorinated organofluorine compounds, is the electrochemical fluorination process commercialized initially in the 1950s by 3M Company, which comprises passing an electric current through an electrolyte, viz., a mixture of fluorinatable organic starting compound and liquid anhydrous hydrogen fluoride, to produce the desired florinated compound or fluorochemical. This fluorination process, commonly referred to as the "Simons electrochemical fluorination process" or, more simply, either the Simons process or Simons ECF, is a highly energetic process which is somewhat hazardous due to the use of anhydrous hydrogen fluoride. Simons ECF cells typically utilize a monopolar electrode assembly, i.e., electrodes connected in parallel through electrode posts to a source of direct current at a low voltage, e.g., four to eight volts. Such cells vary in size from small laboratory cells, which run at currents of from less than one ampere to more than 100 amperes, to large industrial cells, which run at currents as high as 10,000 amperes or more, necessitating the use of heavy-duty, high-cost electrical conductors and bus-work. The cells can be run continuously, semi-continuously, or batch-wise, but the amount of product which can be produced is limited by the amount of current which can be passed through the monopolar electrode assembly, and this is in turn limited due to problems with resistive heating in the electrode posts. Simons ECF cells are generally undivided, single-compartment cells, i.e., the cells typically do not contain anode and cathode compartments separated by a membrane or diaphragm. Although Simons cells generally rely upon bubble generation to effect gas lift or "bubble driven" circulation of electrolyte across the monopolar electrodes (which is on occasion referred to as free convection), external forced convection or agitation improves the uniformity of the ECF environment. The Simons process is disclosed in U.S. Pat. No. 2,519,983 (Simons) and is also described in some detail by J. Burdon and J. C. Tatlow in *Advances in Fluorine Chemistry* (M. Stacey, J. C. Tatlow, and A. G. Sharpe, editors), Volume 1, pages 129–37, Butterworths Scientific Publications, London (1960), by W. V. Childs, L. Christensen, F. W. Klink, and C. F. Kolpin in *Organic Electrochemistry* (H. Lund and M. M. Baizer, editors), Third Edition, pages 1103–12, Marcel Dekker, Inc., New York (1991), and by A. J. Rudge in *Industrial Electrochemical Processes* (A. T. Kuhn, editor), pages 71–75, Marcel Dekker, Inc., New York (1967).

U.S. Pat. No. 3,753,876 (Voss et al.) discloses a process for electrochemical fluorination which comprises circulating a mixture of composition to be fluorinated and anhydrous hydrofluoric acid as electrolyte through a cooling zone, an electrolytic cell, and a relatively large storage zone while removing insoluble fluorination products from the electrolyte before a second passage through said cell.

U.S. Pat. No. 3,957,596 (Seto) describes a process for the production of fluorinated hydrocarbons by electrofluorination, which comprises passing the reactants in the liquid phase along a confined flow path between closely spaced-apart electrodes between which a controlled voltage is applied. The reactants are maintained in the liquid phase by the application of superatmospheric pressure to the cell, and the reactants are passed between the electrodes of the cell in turbulent flow. The electrode gap, the turbulence, and the electrical energy input are controlled to provide improved yield and current efficiency.

U.S. Pat. No. 4,203,821 (Cramer et al.) discloses a continuous-flow cell and process for carrying out electrochemical reactions with improved current efficiency. The cell utilizes bipolar electrodes placed in a frame of non-conducting material.

U.S. Pat. No. 4,406,768 (King) describes an electrochemical cell assembly comprising an essentially cylindrical electrolytic chamber containing a plurality of stacked, bipolar, substantially square parallel-planar electrodes separated from one another by insulative spacers, which also serve as channelling means for the electrolyte. The electrodes are arranged within the chamber so as to define four electrolyte circulation manifolds. The assembly provides means for introducing the electrolyte at one end of the chamber into at least one and not more than two of the manifolds. It also includes means for exiting the electrolyte at the other end of the chamber. U.S. Pat. No. 4,500,403 (King) discloses a divided electrochemical cell assembly having separate anolyte and catholyte circulation manifolds.

Japanese Patent Application No. 2-30785 (Tokuyama Soda KK) discloses a method of fluorination wherein the flow of the electrolytic solution is controlled so as to have a residence time between the electrodes in the range of 0.5–25 seconds per cycle.

An undivided electrohydrodimerization cell for the electrochemical production of adiponitrile from acrylonitrile is described by D. E. Danly in *J. Electrochem. Soc.: REVIEWS AND NEWS* 131(10), 435C–42C (1984). The cell comprises a bipolar electrode stack fitted with a polypropylene housing and contained in a cylindrical vessel, which provides a leak-free means of circulating through the stack an aqueous solution of a quaternary ammonium salt as an electrolyte. Plastic electrode extensions at the inlet and outlet ends of the cell serve to limit current by-passing through the electrolyte in the vessel heads. Divided cells are also described.

The design of electroorganic reactor systems, in regard to hydraulic and electrical distribution schemes, is described by D. E. Danly in *Emerging Opportunities for Electroorganic Processes*, pages 132–36, Marcel Dekker, Inc., New York (1984).

SU 1,666,581 (Gribel et al.) discloses a bipolar filter-press electrolytic cell for electrochemical fluorination.

U.S. Pat. Nos. 4,139,447 (Faron et al.) and 4,950,370 (Tarancon) describe the use of bipolar flow cells in the production of fluorine.

Briefly, in one aspect, this invention provides an undivided electrolytic cell or electrochemical reactor for use in electrochemical fluorination (ECF). This cell comprises a vessel made of, or lined with, a material which is essentially inert to anhydrous hydrogen fluoride and which is preferably electrically-insulating, e.g., poly(vinylidene fluoride). The vessel can be made to be liquid-tight, so as to prevent leakage of the hazardous anhydrous hydrogen fluoride even under superatmospheric pressure. A bipolar electrode stack or pack is mounted within the vessel, the stack comprising a plurality of at least three substantially parallel, spaced-apart electrodes made of an electrically-conductive material, such as nickel, which is essentially inert to anhydrous hydrogen fluoride and which, when used as an anode, is also active for electrochemical fluorination. The electrodes of the electrode stack are arranged in either a series or a series-parallel electrical configuration, preferably a series configuration, and each electrode has at least one electrochemically-active surface and other surfaces, e.g., the ends and the longitudinal edges, which are electrically-insulated. The cell has an inlet for introducing electrolyte, viz., the anhydrous hydrogen fluoride and fluorinatable organic compound, into one end of the vessel and an outlet for removing fluorinated product-containing electrolyte from the other end of the vessel. Between the electrochemically-active surfaces of the electrodes are a plurality of channels for the flow of liquid electrolyte therebetween. The cell further comprises essentially inert, electrically-insulating, substantially liquid-tight means, made of, e.g., poly(tetrafluoroethylene)-coated steel, to divide the interior of the vessel into an inlet chamber and an outlet chamber, and to direct the flow of the electrolyte through the channels; and means, preferably sealed or liquid-tight means, for applying a voltage difference across the electrode stack to cause a direct current to flow through each electrode.

Preferably, the cell of the invention further comprises first and second sets of essentially inert, electrically-insulating means, hereinafter called shunt reducers, which are sealably affixed, i.e., affixed in a liquid-tight manner, to the ends of the electrodes adjacent to the inlet and the outlet, respectively; and essentially inert, electrically-insulating spacer means sealably affixed to, and completely covering, the longitudinal edges of the electrodes, the spacer means spacing apart the electrodes so as to define a plurality of channels for the flow of liquid electrolyte therebetween. The shunt reducer and spacer means serve to reduce shunt currents during operation of the cell. For example, electrically-insulating pieces of plastic can be fitted to the ends or to the longitudinal edges of the electrodes, or the ends of the electrodes can be coated with an electrically-insulating plastic. Each of the first set of shunt reducers contains or defines in part at least one flow passageway which communicates at one end with the inlet chamber and at the other end with a channel, each passageway being of appropriate size and shape, e.g., of appropriate length, cross-sectional area, and hydraulic radius, to minimize shunt currents during operation of the cell without creating an excessive pressure drop, and to distribute electrolyte uniformly to the channel with which the passageway communicates so as to form a plurality of concurrently-flowing, substantially parallel streams of electrolyte. Each of the second set of shunt reducers contains or defines in part at least one flow passageway which communicates at one end with said channel and at the other end with the outlet chamber, each passageway being of appropriate size and shape (which can be different from that of the passageways in the first set of shunt reducers, e.g., to accommodate a reduction in electrolyte density due to bubble formation) to minimize shunt currents without creating an excessive pressure drop. Shunt reducers and spacer means are preferred for use in the cell of the invention because shunt current losses are common in bipolar cells and are even more likely in a bipolar ECF cell, due to the higher conductivity of the electrolyte and the higher voltages utilized.

In another aspect, this invention provides an electrochemical fluorination process comprising passing by forced convection a liquid mixture (electrolyte) comprising anhydrous hydrogen fluoride and fluorinatable organic compound, at a temperature and pressure at which a substantially continuous liquid phase is maintained, via channels between the electrodes of a bipolar electrode stack to which a voltage difference is applied to produce a direct current which causes the production of fluorinated organic compound, the stack comprising a plurality of at least three substantially parallel, spaced-apart electrodes made of an electrically-conductive material which is essentially inert to anhydrous hydrogen fluoride and which, when used as an anode, is also active for electrochemical fluorination, the electrodes being arranged in either a series or a series-parallel electrical configuration, preferably series. Preferably, the liquid mixture is passed between electrodes having sealably affixed shunt reducers.

The process of the invention preferably comprises introducing, preferably continuously, anhydrous hydrogen fluoride and fluorinatable organic compound into an electrolytic cell or vessel so as to form a liquid mixture comprising anhydrous hydrogen fluoride and fluorinatable organic compound; dividing the mixture into a plurality of concurrently-flowing, parallel streams; passing the streams by forced convection, at a temperature and pressure at which a substantially continuous liquid phase is maintained, via channels between the electrodes of a bipolar electrode stack to which a voltage difference is applied to produce a direct current which causes the production of fluorinated organic compound, the stack comprising a plurality of at least three substantially parallel, spaced-apart electrodes made of an electrically-conductive material which is essentially inert to anhydrous hydrogen fluoride and which, when used as an anode, is also active for electrochemical fluorination, the electrodes being arranged in either a series or a series-parallel electrical configuration, preferably series; combining into a single product stream the plurality of streams as they exit the channels, the product stream comprising anhydrous hydrogen fluoride and fluorinated organic compound; and removing, preferably continuously, the single product stream from the cell. The process thus preferably utilizes parallel flow, rather than series flow, i.e., the liquid mixture is preferably passed through the electrode stack in the form of a plurality of concurrently-flowing, parallel streams rather than in the form of a single stream flowing sequentially through the channels between the electrodes of the stack. The forced convection of the liquid can be effected by means such as pumping or stirring, preferably by pumping.

The electrochemical fluorination (ECF) cell and process of the invention utilize bipolar electrodes and thereby are not subject to disadvantages of the monopolar electrical connections typically used in ECF cells. One advantage provided by such a bipolar electrode assembly is lower resistive heating in the electrical connection from the bus bar to the electrode stack. Since resistive heating is lessened, the product output limitations resulting from the resistive heating problems of monopolar electrode assemblies are overcome. The bipolar nature of the cell and process enables the construction and use of large, high-capacity cells which run on low currents, thus eliminating the need for the heavy-duty, high-cost electrical conductors, transformers, rectifiers, and bus-work required for the necessarily high-current operation of large, monopolar cells. Furthermore, power costs are lower for bipolar cells, as transformer and rectifier systems are more efficient when the direct current is produced at a higher voltage.

The ECF process of the invention not only utilizes a bipolar electrode system, but also utilizes forced convection, preferably by pumping, to pass a liquid mixture through the electrode stack or stacks. The use of forced convection enables efficient heat removal and provides for uniform contact of the liquid with the electrode surfaces. This results in higher heat transfer and mass transfer coefficients and in better control of both reactant concentration and charge transfer than can be achieved in conventional ECF processes, which typically rely on bubble-driven circulation. Further, the above-described, preferred parallel flow of the liquid mixture through the electrode stack or stacks can be achieved with simpler manifolding and provides both a lower pressure drop and a lower temperature rise across the cell than does series flow.

In the accompanying drawing.

Figure 1:
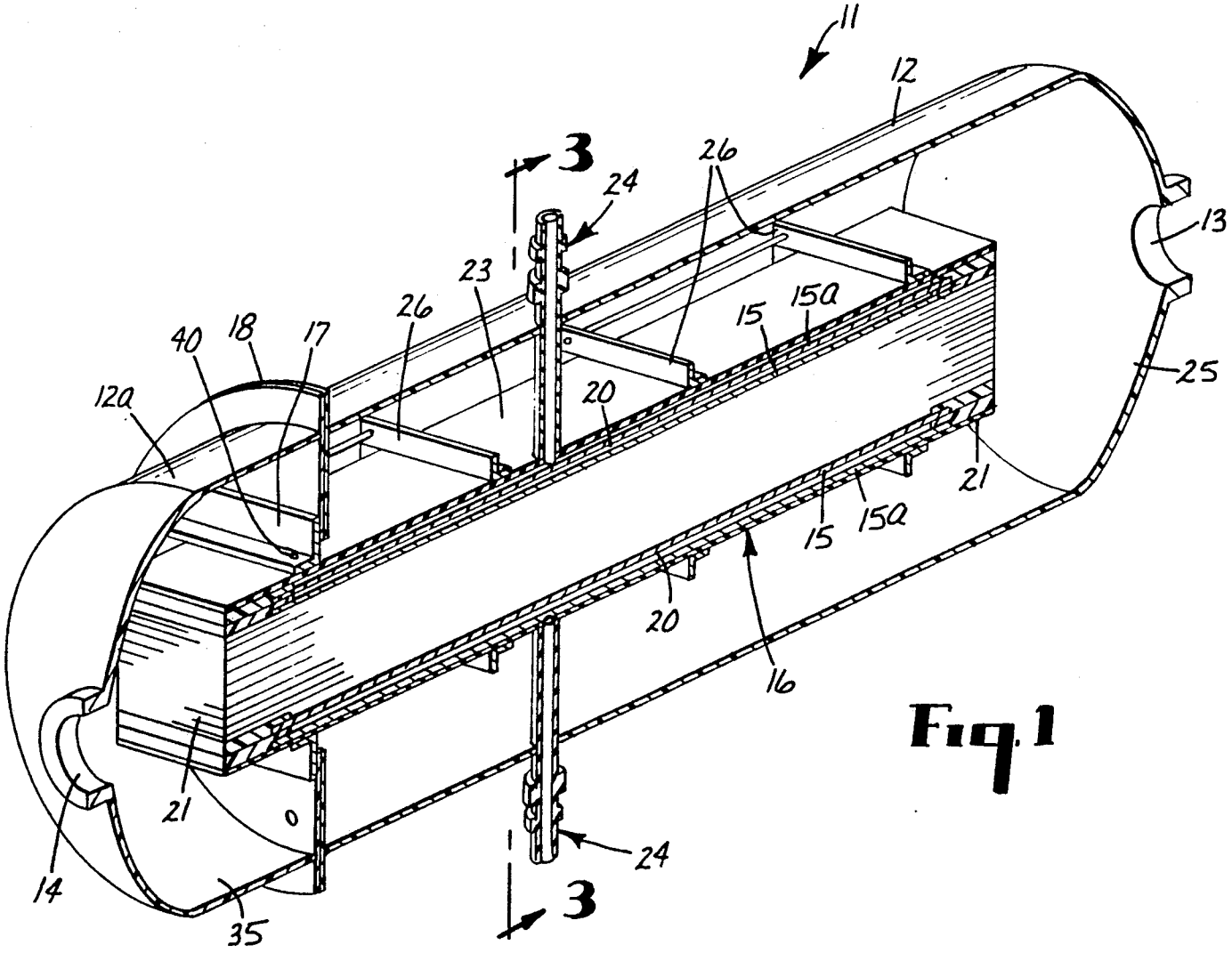
FIG. 1 is an isometric view in partial cross-section of one embodiment of the electrochemical fluorination cell of this invention.

Referring now to the accompanying drawing, FIG. 1 shows a preferred embodiment, generally designated by reference number 11, of the electrochemical fluorination cell of the invention (a bipolar flow cell) comprising a cell vessel or casing 12 which is made of, or lined with, a material which is essentially inert to anhydrous hydrogen fluoride and which is preferably electrically-insulating. Examples of such materials include plastics such as polypropylene, ultra high molecular weight polyethylene, poly(vinylidene fluoride), poly(tetrafluoroethylene), and poly(chlorotrifluoroethylene). Poly(vinylidene fluoride) is generally preferred due to its resistance to anhydrous hydrogen fluoride and its ease of fabrication. When the cell vessel is lined with plastic, the vessel itself can be made of, e.g., steel. The vessel 12 can have a removable vessel head **12*a* and is provided with an inlet 13, which can be fitted with a valve not shown, for introducing liquid anhydrous hydrogen fluoride and fluorinatable organic compound, e.g., tripropyl amine, into the vessel to form a liquid mixture comprising anhydrous hydrogen fluoride and fluorinatable organic compound, and is provided with an outlet 14, which can also be fitted with a valve, for removing a product stream comprising anhydrous hydrogen fluoride and fluorinated organic compound, e.g., perfluoro(tripropyl amine), from the vessel. A bipolar electrode stack 16 is mounted, preferably suspended, within the vessel 12 by means of electrically-insulated brackets 17. If desired, a plurality of bipolar electrode stacks can be utilized. The brackets 17 attach by fastening means such as bolts, screws, or pins to a seal plate 18, made of plastic or plastic coated metal, e.g., poly(vinylidene fluoride)-coated steel, which attaches to the vessel 12 by means such as flanges and serves to prevent the liquid mixture from bypassing the electrode stack 16. Alternatively, the brackets 17 can attach directly to the vessel 12, and other substantially liquid-tight means, e.g., solid filler or packing which is electrically-insulating and essentially inert to anhydrous hydrogen fluoride, can be utilized to prevent liquid bypass, i.e., to direct the liquid mixture through electrode stack 16 as will be described below. If desired, the seal plate 18** can contain a small hole to enable drainage of electrolyte from the outlet chamber prior to disassembly of the cell.

The bipolar electrode stack 16 includes at least three electrode plates 15 which are preferably rectangular in shape and which are arranged so as to be longitudinally aligned in a substantially parallel, spaced-apart relationship. The electrodes 15 are made of a material which is both electrically-conductive and essentially inert to anhydrous hydrogen fluoride and which, when used as an anode, is also active for electrochemical fluorination, for example, nickel or platinum. Nickel is generally preferred because it is less expensive. Since the electrodes 15 are arranged so as to be electrically in series, the outermost electrodes **15*a* of the stack 16** are monopolar (with one electrochemically-active surface) and the interior electrode or electrodes are bipolar (with two electrochemically-active surfaces).

The electrodes 15 of the electrode stack 16 are separated or spaced apart by side spacers 19 (see FIG. 2 and FIG. 5) disposed between the electrodes 15 to define a plurality of channels 20 (see FIG. 2 and FIG. 3) therebetween. The spacers 19 are rectangular in shape and are notched so that they can fit onto and completely cover the longitudinal edges of the electrodes 15. The spacers 19 extend the full length of the electrodes plus the length of shunt reducers 21 (see FIG. 1, FIG. 2, and FIG. 5), which are fitted onto the ends of the electrodes. The spacers 19 and the reducers 21 are made of an electrically-insulating material which is essentially inert to anhydrous hydrogen fluoride. For example, polypropylene, ultra high molecular weight polyethylene, poly(vinylidene fluoride), and poly(chlorotrifluoroethylene) can be utilized to make the spacers 19 and the reducers 21. Ultra high molecular weight polyethylene is generally preferred from a cost perspective. If desired, additional spacing means can be utilized between opposing electrode faces to further ensure electrode separation.

Figure 2:
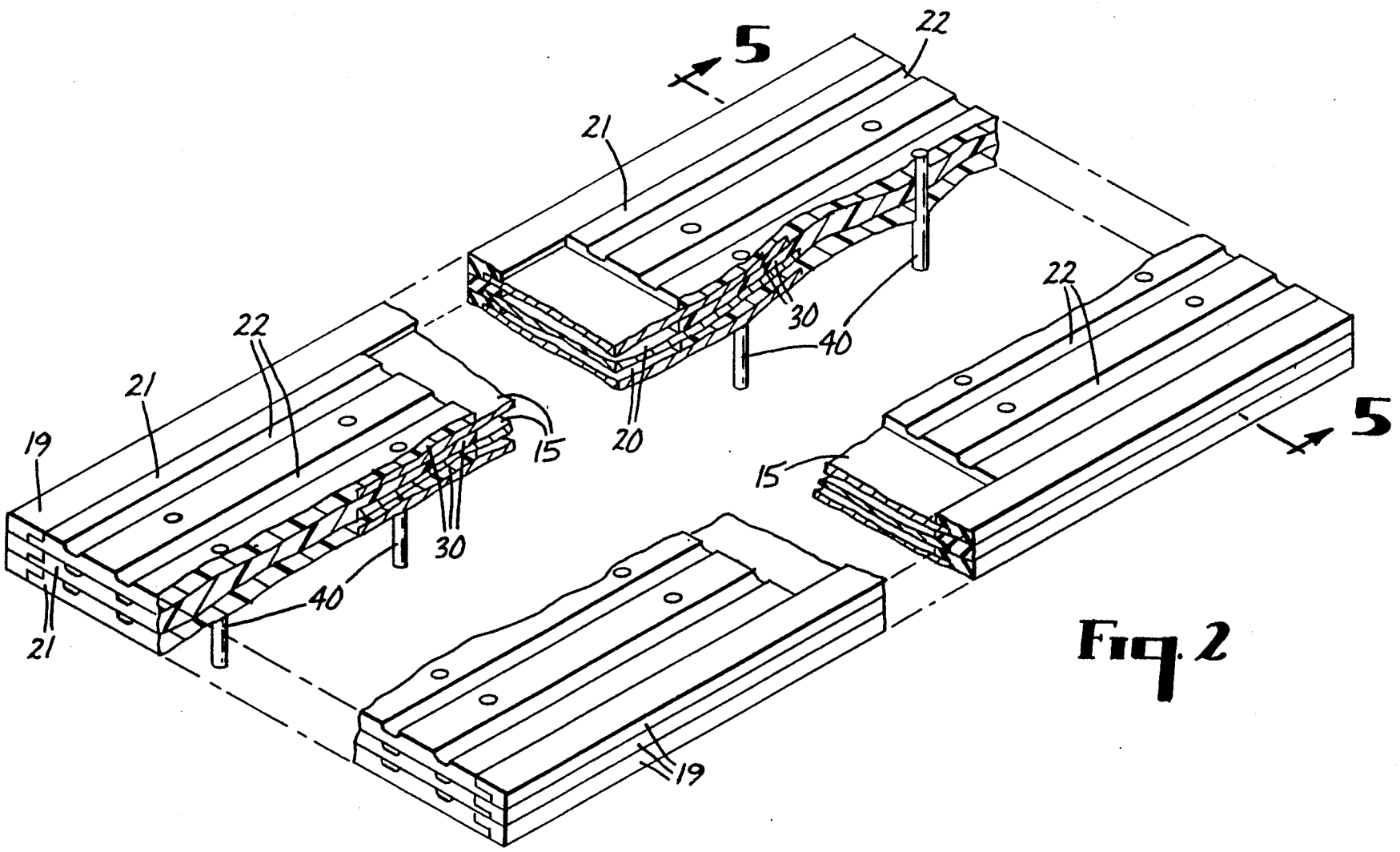
FIG. 2 is a broken isometric view in partial cross-section of a plurality of assembled shunt reducers of FIG. 1.
Figure 3:
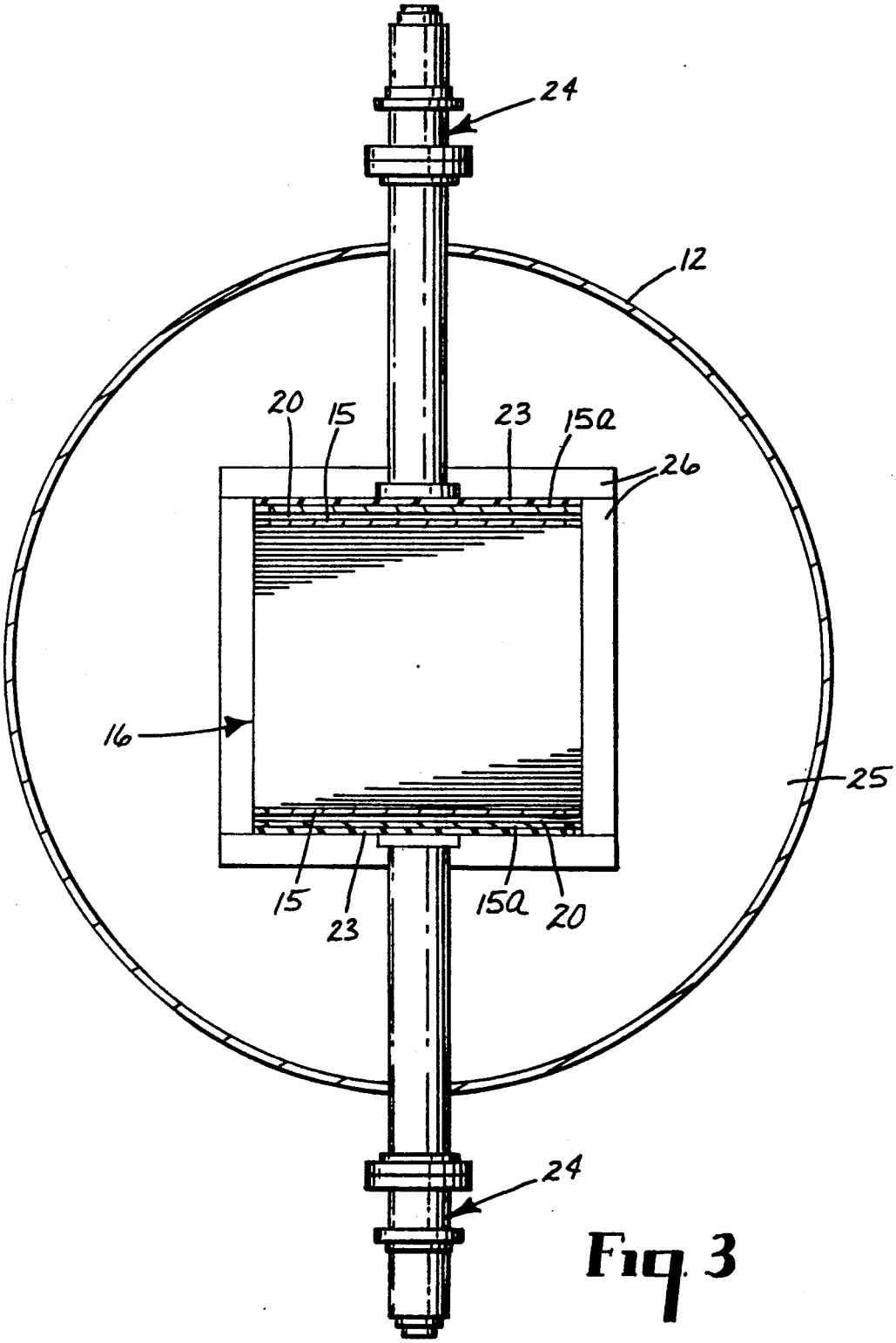
FIG. 3 is a transverse cross-sectional view of the electrochemical fluorination cell of FIG. 1 taken along the plane 3—3 and showing a cross-section of the entire cell.
Figure 5:
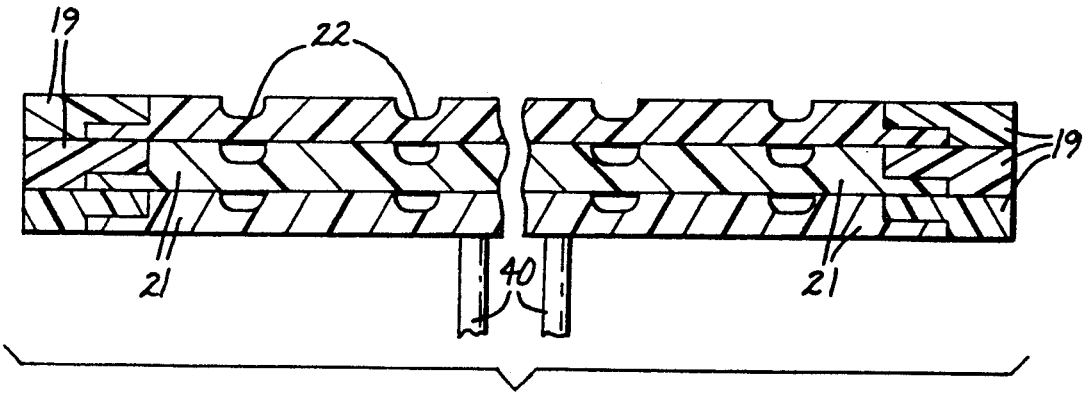
FIG. 5 is a cross-sectional view of the assembled shunt reducers of FIG. 2 taken along the plane 5—5.

The shunt reducers 21 can be rectangular flat sheets which contain on one face a plurality of longitudinally aligned, spaced apart, parallel grooves which can be modified in shape at their ends, e.g., by flaring or by other known techniques used in designing flow passageways, if desired, to reduce or minimize entrance- and exit-effect pressure drops. When the reducers 21 are assembled with the grooved faces overlaid by the flat or non-grooved faces of contiguous reducers, flow passageways or subchannels 22 are defined. The subchannels 22 in the shunt reducers 21 which are fitted to the ends of the electrodes 15 adjacent to inlet 13 communicate at one end with inlet chamber 25 (see FIG. 1) and at the other end with the channels 20 between the electrodes 15. The subchannels 22 in the shunt reducers 21 which are fitted to the ends of the electrodes 15 adjacent to outlet 14 communicate at one end with the channels 20 and at the other end with outlet chamber 35. Although FIG. 2 and FIG. 5 show a preferred shape for the subchannels 22, other shapes can be utilized. The end portions of the electrodes 15 each fit in a recessed portion 30 (see FIG. 2) of the non-grooved face of each of the reducers 21. The reducers 21 are of sufficient length and the subchannels 22 are of appropriate size and shape to distribute liquid uniformly to each of the channels 20 and to reduce shunt current losses (to preferably less than about 10% of the total current), without creating an excessive pressure drop. The size and shape, e.g., the length, cross-sectional area, and hydraulic radius, necessary for a particular electrolyte flow and shunt current limitation can be determined by calculation, as described by D. E. Danly in *Emerging Opportunities for Electroorganic Processes*, pages 166–174, Marcel Dekker, Inc., New York (1984), which description is incorporated herein by reference. Since conventional sealants typically are not inert to anhydrous hydrogen fluoride and thus generally cannot be utilized in electrochemical fluorination cells, the side spacers 19 and the shunt reducers 21 are preferably fitted so as to be liquid-tight. This constrains the liquid mixture to a flow path, as will be described below, through the channels 20. If desired, each set of shunt reducers 21 can be in the form of a one-piece shunt reducer affixed to the electrode stack and fabricated to contain flow passageways. Fitted shunt reducers are preferred, as they provide flexibility in fabrication and design of the flow passageway.

The electrode stack 16, fitted with the side spacers 19 and the shunt reducers 21, can be held together by compression means, for example, one or more tie rods 40 (see FIG. 2 and FIG. 5) which extend through the reducers 21 between the subchannels 22. An insulation layer 23 (see FIG. 1), comprising a flat, preferably rectangular sheet made of an electrically-insulating material which is essentially inert to anhydrous hydrogen fluoride, can be disposed on the exterior face of each of the outermost electrodes 15*a* of the electrode stack 16 and serves to insulate the exterior faces from electrolyte, while also providing mechanical support to the electrode stack 16. If desired, a metal, for example, nickel, layer or frame, such as angle brackets 26 connected by tie rods, can be disposed exterior to the insulation layer 23 to provide additional mechanical support to the electrode stack 16.

Figure 4:
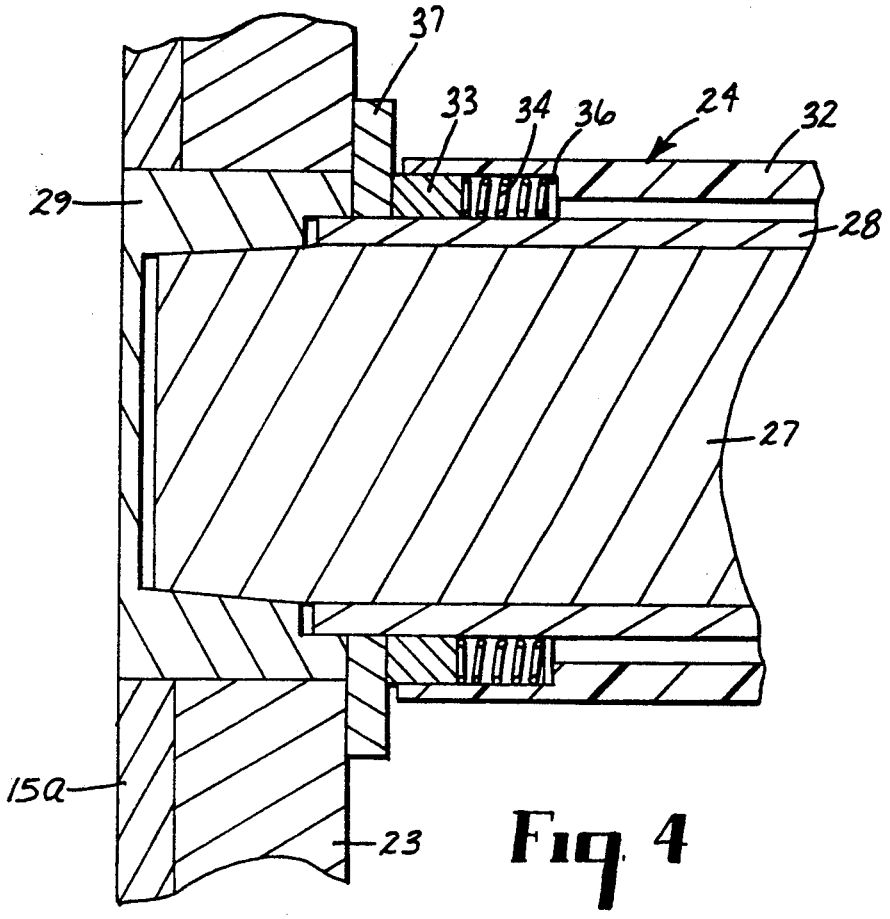
FIG. 4 is a detailed cross-sectional view of a portion of the electrical connector and adjacent insulation layer and electrode stack of FIG. 1.

Direct electrical current is supplied to the electrode stack 16 by means of electrical connectors 24, which are cylindrical in shape and radially protrude from the cell vessel 12 at locations intermediate to the inlet 13 and the outlet 14. The electrical connectors 24 include an electrode post 27 (see FIG. 4) made of copper or another conductive metal such as nickel. The post 27 is preferably circular in cross-section and, if additional mechanical strength is desired, is disposed in tubing 28 made of a material which has greater mechanical strength than copper, for example, nickel, steel, or alloys such as Monel TM (an alloy of predominately nickel and copper). The tubing 28 threadably engages a cup-shaped adaptor 29 and thereby seats the post 27 in the self-holding taper of adaptor 29, generally leaving a space between the adaptor 29 and the post 27. The adaptor 29, made of an electrically-conductive material which is essentially inert to anhydrous hydrogen fluoride, e.g., nickel or platinum, is disposed in a complementary hole which extends through both insulation layer 23 and outermost electrode 15*a*. To complete the electrical connection, adaptor 29 is welded to outermost electrode 15*a*. Tubing 28 is disposed in a plastic sheath 32 so as to form an annular space between the tubing 28 and the sheath 32. A cutaway portion of sheath 32 accommodates a plurality of chevron seals 33, made of an electrically-insulating material which is essentially inert to anhydrous hydrogen fluoride, e.g., polypropylene, ultra high molecular weight polyethylene, poly(vinylidene fluoride), poly(tetrafluoroethylene), or poly(-chlorotrifluoroethylene), and also accommodates one or more wave springs 34 supported by a metal washer 36. The seals 33 contact a plastic ring 37, which is melt-welded to the insulation layer 23 and serves to insulate the adaptor 29 from liquid anhydrous hydrogen fluoride. The plastic sheath 32, seals 33, and ring 37 collectively function to seal the electrical connectors 24 from anhydrous hydrogen fluoride. Alternatively, the connectors 24 can be sealed by having sheath 32 threadably engage insulation layer 23. Other means of sealing that will be apparent to those skilled in the art can also be utilized.

Figure 6:
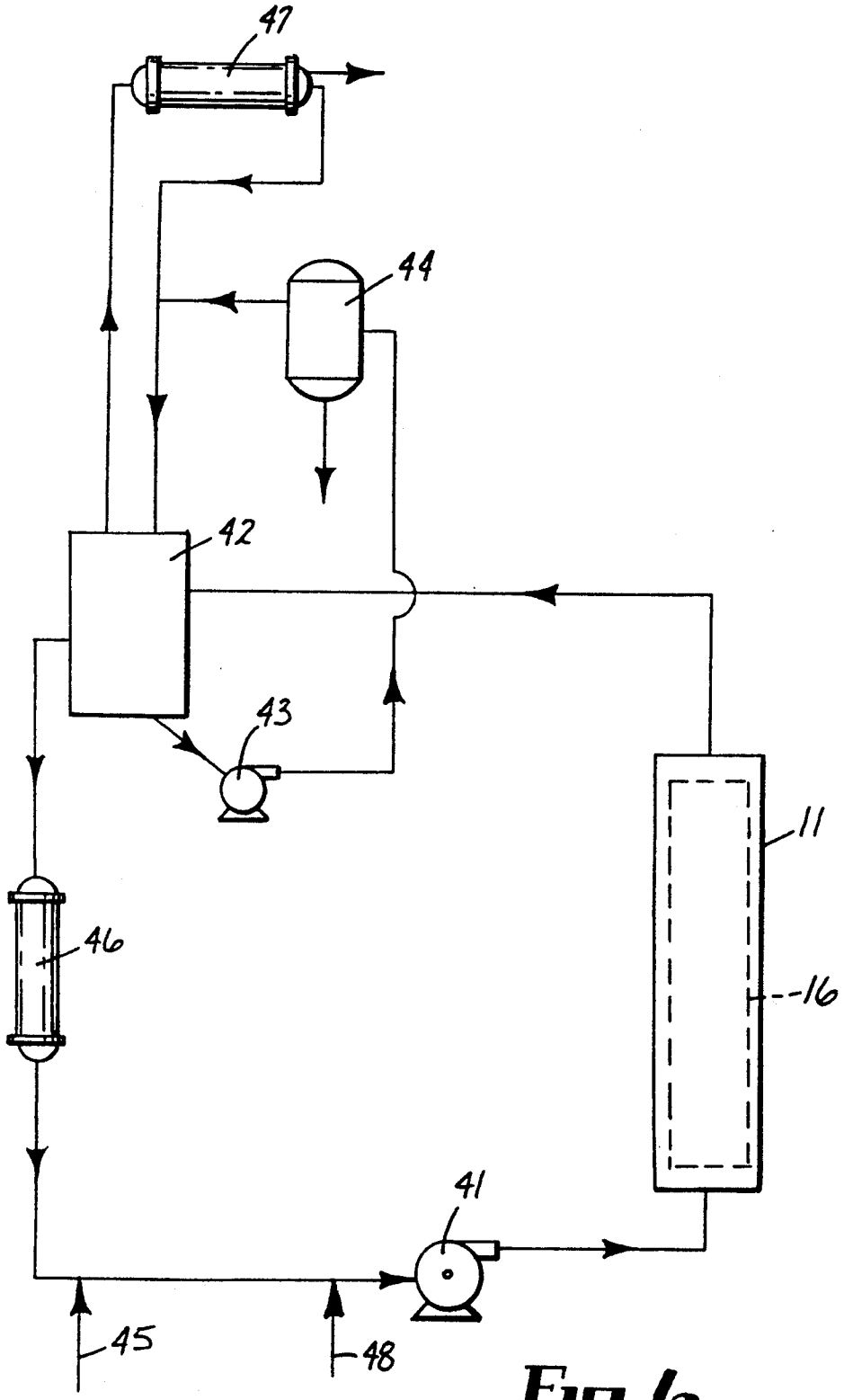
FIG. 6 is a schematic diagram of the electrochemical fluorination cell of FIG. 1 and its associated supply and recovery apparatus.

Cell 11 is associated with supply and recovery apparatus in the form of pump 41 (see FIG. 6), which feeds streams of anhydrous hydrogen fluoride 45 and fluorinatable organic compound 48 to cell 11; vapor-liquid separator 42, which receives the cell effluent and enables the separation of liquid and gaseous effluent; pump 43, which can be used for transfer of the liquid effluent from vapor-liquid separator to product separator 44, which can be a distillation unit, extraction unit, or other type of product recovery unit, or which can function to collect the liquid effluent and enable its phase-separation into top and bottom liquid phases; gas cooler 47, which receives the gaseous effluent; and cooler 46, which receives from separator 42 the condensed gaseous effluent from gas cooler 47 and the top liquid phase of the liquid effluent from product separator 44.

In operation, anhydrous hydrogen fluoride and fluorinatable organic compound are pumped by means of pump 41 (see FIG. 6) into cell 11 through inlet 13 (see FIG. 1). The liquid mixture fills inlet chamber 25 and is directed by means of seal plate 18 through the subchannels 22 in the shunt reducers 21 at the inlet end of the cell. The liquid mixture flows through the channels 20 between the electrodes 15 of electrode stack 16, to which a voltage difference is applied by means of electrical connectors 24 to produce a direct current which can cause the fluorination of the fluorinatable organic compound, e.g., 4–8 volts per anode-cathode pair. After passage of the liquid mixture through the electrode stack 16, the resulting effluent, comprising anhydrous hydrogen fluoride, fluorinated organic compound, and hydrogen, then passes through the subchannels 22 in the shunt reducers 21 at the outlet end of cell 11 and through outlet chamber 35 before exiting the cell through outlet 14.

Next, the effluent enters vapor-liquid separator 42 (see FIG. 6), from which the liquid phase is transferred, optionally, by means of pump 43, to product separator 44, where, when perfluorinated product has been produced, it phase-separates. The bottom liquid phase, comprising fluorinated organic compound, is removed from product separator 44 continuously, semi-continuously, or batch-wise, and the top liquid phase, comprising anhydrous hydrogen fluoride and fluorinatable organic compound, is returned to vapor-liquid separator 42, from which it is passed through cooler 46 and recycled, preferably continuously, back to pump 41 and cell 11. Meanwhile, the vapor phase of the effluent in vapor-liquid separator 42 is passed through gas cooler 47 to condense the condensible portion. The condensed gases are returned to vapor-liquid separator 42, where they are combined with the above-described top liquid phase and then passed through cooler 46 and recycled, preferably continuously, back to pump 41 and cell 11. Any noncondensible gases are vented from gas cooler 47.

The organic compounds which can be utilized as starting materials in the process of the invention are those which are "fluorinatable," i.e., those which contain carbon-bonded hydrogen atoms which are replaceable by fluorine and can contain carbon-carbon unsaturation which is saturateable with fluorine. Representative examples of compounds which can be fluorinated by the process of this invention include organic acid halides, ethers, esters, amines, amino ethers, aliphatic hydrocarbons, halohydrocarbons, and divalent and hexavalent sulfur compounds. The ECF of these compounds can be enhanced in many cases by adding conventional conductivity additives such as sodium fluoride, acetic anhydride, or an organic sulfur-containing additive such as that described in U.S. Pat. Nos. 3,028,321 (Danielson); 3,692,643 (Holland); and 4,739,103 (Hansen).

This invention is further illustrated by the following examples, but the particular materials and amounts thereof recited in these examples, as well as other conditions and details, should not be construed to unduly limit this invention.

EXAMPLES

Example 1

This example describes the electrochemical fluorination (ECF) of tripropyl amine using an ECF cell of this invention containing a bipolar electrode stack with sealably affixed shunt reducers formed by coating the ends of the electrodes with poly(vinylidene fluoride).

400 g tripropyl amine and 9 kg anhydrous hydrogen fluoride (AHF) were pumped through the inlet and into the inlet chamber of a cell vessel which contained a bipolar electrode stack, forming a liquid electrolyte solution. The bipolar stack comprised two outermost monopolar electrodes and three interior bipolar electrodes, each having dimensions of 946 mm×51 mm×2 mm, and each bearing shunt reducers formed by applying a 0.076 mm thick coating of poly(vinylidene fluoride) to each electrode end for a length of 152 mm. The electrodes were made of nickel and were spaced 2 mm apart.

The cell was operated continuously at 20.1 volts, 21 amps, 50° C. and 308 kPa, and the electrolyte solution was continuously passed through the channels between the electrodes of the bipolar electrode stack at a flow rate of 5.9 kg/min. An additional 7 g of tripropyl amine was pumped into the inlet chamber of the vessel through the inlet while hydrogen gas evolution was measured. The product-containing electrolyte resulting from the fluorination flowed into the outlet chamber of the vessel and through the outlet and was delivered to a vapor-liquid separator where the gaseous product mixture was separated from the liquid product mixture. A portion of the liquid product mixture was transferred to a product separator where it phase separated into an upper AHF-containing phase and a lower fluorinated product phase. The upper phase was continuously returned to the cell via the inlet. The current efficiency for hydrogen evolution was estimated to be 89% by measuring the volume of hydrogen gas evolved over a period of time. A similar run using a monopolar electrode stack had a current efficiency of 95%, indicating that shunt current losses for the bipolar run were quite low, i.e., about 6% of the total current.

Example 2

This example describes the electrochemical fluorination (ECF) of octane sulfonyl fluoride using an ECF cell of this invention containing a bipolar electrode stack with sealably fitted shunt reducers made of ultra high molecular weight polyethylene.

9 kg anhydrous hydrogen fluoride (AHF) and a solution of 0.3 kg octane sulfonyl fluoride in 0.2 kg dimethyl disulfide (DMDS) conductivity additive were pumped through the inlet and into the inlet chamber of a cell vessel which contained a bipolar electrode stack, forming a liquid electrolyte solution. The bipolar stack comprised two outermost monopolar electrodes and two interior bipolar electrodes, each having dimensions of 740 mm×26 mm×2 mm and each bearing fitted shunt reducers on both electrode ends. The shunt reducers were made of ultra high molecular weight polyethylene and were sealably fitted to the electrode ends by means of carefully-machined recessed portions of the reducers. Each reducer contained a machined electrolyte flow passageway which extended the length of the reducer (152 mm) and which was approximately 10 $mm^2$ in cross-sectional area. The electrodes were made of nickel and were spaced 3.2 mm apart.

The cell was operated continuously at 15.0–22.2 volts, 10–47 amps, 53° C., and 315 kPa, and the electrolyte solution was continuously passed through the channels between the electrodes of the bipolar electrode stack at a flow rate of 2.7–8.0 kg/min. Additional fluorinatable organic compound was pumped through the inlet and into the inlet chamber of the vessel in the form of a solution of 0.2 kg DMDS in 3.1 kg octane sulfonyl fluoride; an estimated additional 6.7 kg AHF was also added during the operation. The cell effluent, after passing through the outlet chamber and the outlet of the vessel, was delivered to a vapor-liquid separator where the gaseous product mixture was separated from the liquid product mixture. The gaseous product mixture was condensed in a −40° C. condenser, while the liquid product mixture was phase-separated to yield an upper AHF-containing phase and a lower fluorinated product phase which was separated from the upper phase by draining to yield 3.1 kg of crude fluorinated products. The upper phase was continuously returned to the cell via the inlet. The crude fluorinated products were filtered using glass wool, and gas chromatographic analysis of the filtered crude indicated that a 64% by weight yield of perfluoro (octane sulfonyl fluoride) had been obtained. The current efficiency for hydrogen evolution was estimated to be 93% by measuring the volume of hydrogen gas evolved over a period of time. A similar run using a monopolar electrode stack had a current efficiency of 94%, indicating that shunt current losses for the bipolar run were quite low, i.e., about 1% of the total current.

Example 3

This example describes the electrochemical fluorination (ECF) of tributyl amine using an ECF cell containing a bipolar electrode stack with poly(tetrafluoroethylene) shunt reducers which were attached in a butt-joint manner, rather than being sealably affixed.

9 kg anhydrous hydrogen fluoride (AHF) and a solution of 260 g tributyl amine in 16 g dimethyl disulfide (DMDS) conductivity additive were pumped through the inlet and into the inlet chamber of a cell vessel which contained a bipolar electrode stack, forming a liquid electrolyte solution. The bipolar stack comprised two outermost monopolar electrodes and three interior bipolar electrodes, each having dimensions of 946 mm×60 mm×2 mm and each bearing shunt reducers in the form of 50 mm long×60 mm wide X 2 mm thick strips of poly(tetrafluoroethylene) on both electrode ends. The reducers were attached to the electrodes in a butt-joint manner. The electrodes were made of nickel and were spaced 2.4 mm apart.

The cell was operated continuously at 22.2–24.5 volts, 50–100 amps, 54° C., and 413 kPa, and the electrolyte solution was continuously passed through the channels between the electrodes of the bipolar electrode stack at a flow rate of 4–5.5 kg/min. Additional fluorinatable organic compound was pumped through the inlet and into the inlet chamber of the vessel in the form of a solution of 330 g DMDS in 8.2 kg tributyl amine; an estimated additional 19.5 kg AHF was also added during the operation. The cell effluent, after passing through the outlet chamber and the outlet of the vessel, was delivered to a vapor-liquid separator, where the gaseous product mixture was separated from the liquid product mixture. The gaseous product mixture was condensed in a −40° C. condenser, while the liquid product mixture was phase-separated to yield an upper AHF phase and a lower fluorinated product phase which was separated from the upper phase by draining to yield 16.3 kg of crude fluorinated products. The upper phase was continuously returned to the cell via the inlet. The current efficiency for hydrogen evolution was estimated to be 53–72% by measuring the volume of hydrogen gas evolved over a period of time. A similar run using a monopolar electrode stack had a current efficiency of 94%, indicating that shunt current losses for the bipolar run were about 22–41% of the total current.

Example 4

This example describes the electrochemical fluorination (ECF) of octane sulfonyl fluoride using an ECF cell containing a bipolar electrode stack with poly(tetrafluoroethylene) shunt reducers which were attached in a butt-joint manner, rather than being sealably affixed.

150 g octane sulfonyl fluoride and 9 kg anhydrous hydrogen fluoride (AHF) were pumped through the inlet and into the inlet chamber of a cell vessel which contained a bipolar electrode stack, forming a liquid electrolyte solution. The bipolar stack comprised two outermost monopolar electrodes and two interior bipolar electrodes, each having dimensions of 946 mm×60 mm×2 mm and each bearing shunt reducers in the form of 50 mm long×60 mm wide×2 mm thick strips of poly(tetrafluoroethylene) on both electrode ends. The reducers were attached to the electrodes in a butt-joint manner. The electrodes were made of nickel and were spaced 2 mm apart.

The cell was operated continuously at 15.6–22.5 volts, 30–100 amps, 50° C., and 370 kPa, and the electrolyte solution was continuously passed through the channels between the electrodes of the bipolar electrode stack at a flow rate of 5–10 kg/min. Additional fluorinatable organic compound was pumped through the inlet and into the inlet chamber of the vessel in the form of a solution of 1.6 kg dimethyl disulfide in 24.8 kg octane sulfonyl fluoride; an estimated additional 45 kg AHF was also added during the operation. The cell effluent, after passing through the outlet chamber and the outlet of the vessel, was delivered to a vapor-liquid separator where the gaseous product mixture was separated from the liquid product mixture. The gaseous product mixture was condensed in a −40° C. condenser, while the liquid product mixture was phase-separated to yield an upper AHF phase and a lower fluorinated product phase which was separated from the upper phase by draining to yield 45.1 kg of crude fluorinated products. The upper phase was continuously returned to the cell via the inlet. The crude fluorinated products were filtered using glass wool, and gas chromatographic analysis of the filtered crude indicated that a 64% by weight yield of perfluoro (octane sulfonyl fluoride) had been obtained. The current efficiency for hydrogen evolution was estimated to be 85% by measuring the volume of hydrogen gas evolved over a period of time. A similar run using a monopolar electrode stack had a current efficiency of 94%, indicating that shunt current losses for the bipolar run were about 9% of the total current.

Various modifications and alterations of this invention will become apparent to those skilled in the art without departing from the scope and spirit of this invention.

We claim:

1. An electrochemical fluorination cell comprising a vessel which is essentially inert to anhydrous hydrogen fluoride; a bipolar electrode stack mounted within said vessel, said stack comprising a plurality of substantially parallel electrodes made of an electrically-conductive material which is essentially inert to anhydrous hydrogen fluoride and which, when used as an anode, is active for electrochemical fluorination, said electrodes being spaced apart so as to form a plurality of channels for the flow of liquid electrolyte therebetween and being arranged in either a series or a series-parallel electrical configuration; an inlet for introducing electrolyte into one end of said vessel; an outlet for removing electrolyte from the other end of said vessel; essentially inert, electrically-insulating, substantially liquid-tight means for dividing the interior of said vessel into an inlet chamber and an outlet chamber and for directing the flow of liquid electrolyte through said channels; a first set of essentially inert, electrically-insulating shunt reducers sealably affixed to the ends of said electrodes adjacent to said inlet, each said reducer containing or defining in part at least one flow passageway which communicates at one end with said inlet chamber and at the other end with one of said channels, each said passageway being of appropriate size and shape to minimize shunt currents during operation of said cell without creating an excessive pressure drop and to distribute electrolyte uniformly to the channel with which said passageway communicates so as to form a plurality of concurrently-flowing, substantially parallel streams of electrolyte; a second set of essentially inert, electrically-insulating shunt reducers sealably affixed to the ends of said electrodes adjacent to said outlet, each of said latter reducers containing or defining in part at least one flow passageway which communicates at one end with one of said channels and at the other end with said outlet chamber, each of said latter passageways being of appropriate size and shape to minimize shunt currents without creating an excessive pressure drop; essentially inert, electrically-insulating spacer means sealably affixed to, and completely covering, the longitudinal edges of said electrodes, said spacer means spacing apart said electrodes so as to define a plurality of channels for the flow of liquid electrolyte therebetween; and means for applying a voltage difference across said electrode stack to cause a direct current to flow through each said electrode.

2. The cell of claim 1 wherein said vessel is also electrically-insulating.

3. The cell of claim 1 wherein said electrical configuration is a series configuration.

4. The cell of claim 1 wherein said first set and said second set of shunt reducers are sealably affixed plastic coatings on end portions of said electrodes.

5. The cell of claim 1 wherein said first set and said second set of shunt reducers are sealably-affixed pieces of plastic fitted to the ends of said electrodes.

6. The cell of claim 1 wherein said means for applying a voltage to said electrodes is sealed.

7. An electrochemical fluorination process comprising passing by forced convection a liquid mixture consisting essentially of anhydrous hydrogen fluoride and fluorinatable organic compound, at a temperature and pressure at which a substantially continuous liquid phase is maintained, between the electrodes of a bipolar electrode stack to which a voltage difference is applied to produce a direct current which causes the production of fluorinated organic compound, said stack comprising a plurality of said electrodes, which are substantially parallel, spaced-apart, and made of an electrically-conductive material which is essentially inert to anhydrous hydrogen fluoride and which, when used as an anode, is active for electrochemical fluorination, said electrodes being arranged in either a series or a series-parallel electrical configuration.

8. The process of claim 7 wherein said forced convection is effected by pumping.

9. The process of claim 7 wherein said electrical configuration is a series configuration.

10. The process of claim 7 wherein said electrodes have sealably-affixed shunt reducers.

11. The process of claim 7 wherein said fluorinatable organic compound is tripropyl amine and said fluorinated organic compound is perfluoro(tripropyl amine).

12. The process of claim 7 wherein said fluorinatable organic compound is octane sulfonyl fluoride and said fluorinated organic compound is perfluoro (octane sulfonyl fluoride).

13. The process of claim 7 wherein said fluorinatable organic compound is tributyl amine and said fluorinated organic compound is perfluoro(tributyl amine).

14. An electrochemical fluorination process comprising introducing anhydrous hydrogen fluoride and fluorinatable organic compound into an electrolytic cell so as to form a liquid mixture consisting essentially of anhydrous hydrogen fluoride and fluorinatable organic compound; dividing said mixture into a plurality of concurrently-flowing, parallel streams; passing said streams by forced convection, at a temperature and pressure at which a substantially continuous liquid phase is maintained, via channels between the electrodes of a bipolar electrode stack to which a voltage difference is applied to produce a direct current which causes the production of fluorinated organic compound, said stack comprising a plurality of said electrodes, which are substantially parallel, spaced-apart, and made of an electrically-conductive material which is essentially inert to anhydrous hydrogen fluoride and which, when used as an anode, is active for electrochemical fluorination; combining into a single product stream said plurality of streams as they exit said channels, said product stream comprising anhydrous hydrogen fluoride and fluorinated organic compound; and removing said single product stream from said cell.

15. The process of claim 14 wherein said introduction and said removal are carried out continuously.

16. The process of claim 15 further comprising the steps of continuously separating a portion of said single product stream from the remainder of said single product stream and continuously returning said portion to said cell.

17. An electrochemical fluorination process comprising passing by forced convection a liquid mixture comprising anhydrous hydrogen fluoride and fluorinatable organic compound, at a temperature and pressure at which a substantially continuous liquid phase is maintained, between the electrodes of a bipolar electrode stack to which a voltage difference is applied to produce a direct current which causes the production of fluorinated organic compound, said stack comprising a plurality of said electrodes, which are substantially parallel, spaced-apart, and made of an electrically-conductive material which is essentially inert to anhydrous hydrogen fluoride and which, when used as an anode, is active for electrochemical fluorination, said electrodes being arranged in either a series or a series-parallel electrical configuration and having sealably-affixed shunt reducers.

18. An electrochemical fluorination process comprising passing by forced convection a liquid mixture comprising anhydrous hydrogen fluoride and octane sulfonyl fluoride, at a temperature and pressure at which a substantially continuous liquid phase is maintained, between the electrodes of a bipolar electrode stack to which a voltage difference is applied to produce a direct current which causes the production of perfluoro(octane sulfonyl fluoride), said stack comprising a plurality of said electrodes, which are substantially parallel, spaced-apart, and made of an electrically-conductive material which is essentially inert to anhydrous hydrogen fluoride and which, when used as an anode, is active for electrochemical fluorination, said electrodes being arranged in either a series or a series-parallel electrical configuration.

* * * * *

UNITED STATES PATENT AND TRADEMARK OFFICE

CERTIFICATE OF CORRECTION

PATENT NO. : 5,322,597

DATED : June 21, 1994

INVENTOR(S) : William V. Childs, Frank W. Klink, John C. Smeltzer, & Jeffrey C. Spangler It is certified that error appears in the above-indentified patent and that said Letters Patent is hereby corrected as shown below:

Column 01, line 18 "Scotchgard TM" should read --Scotchgard ™--.

Column 09, line 68 "50° C." should read --50° C--.

Column 10, line 49 "53° C." should read --53° C--.

Column 10, line 62 " -40° C." should read -- -40° C--.

Column 11, line 33 "54° C." should read --54° C--.

Column 11, line 46 " -40° C." should read -- -40° C--.

Column 12, line 13 "50° C." should read --50° C--.

UNITED STATES PATENT AND TRADEMARK OFFICE

CERTIFICATE OF CORRECTION

PATENT NO. : 5,322,597

DATED : June 21, 1994

INVENTOR(S) : William V. Childs, Frank W. Klink, John C. Smeltzer, & Jeffrey C. Spangler It is certified that error appears in the above-indentified patent and that said Letters Patent is hereby corrected as shown below:

Column 12, line 26 " -40° C." Should read -- -40° C--.

Signed and Sealed this

Fifth Day of December, 1995

Bruce Lehman

*Attest:*

BRUCE LEHMAN

*Attesting Officer*

*Commissioner of Patents and Trademarks*